US008795104B1

(12) United States Patent
Hice et al.

(10) Patent No.: US 8,795,104 B1
(45) Date of Patent: Aug. 5, 2014

(54) GOLF TEE POSITIONING TOOL

(76) Inventors: Velvet Hice, Fort Smith, AR (US); Danny Ivy, Lavaca, AR (US); Mark Gibson, Van Buren, AR (US)

( * ) Notice: Subject to any disclaimer, the term of this patent is extended or adjusted under 35 U.S.C. 154(b) by 17 days.

(21) Appl. No.: 13/584,875

(22) Filed: Aug. 14, 2012

(51) Int. Cl.
*A63B 57/00* (2006.01)

(52) U.S. Cl.
USPC ..... 473/386

(58) Field of Classification Search
USPC ..... 473/386, 387, 398, 400; D21/718, 793
See application file for complete search history.

(56) References Cited

U.S. PATENT DOCUMENTS

| | | | | | |
|---|---|---|---|---|---|
| 1,846,407 | A | * | 2/1932 | Thompson | 473/391 |
| 2,801,852 | A | * | 8/1957 | Hottle | 473/386 |
| 2,950,110 | A | * | 8/1960 | Slotta et al. | 473/386 |
| 3,312,468 | A | * | 4/1967 | Lynch | 473/133 |
| 3,540,727 | A | * | 11/1970 | Hoe, Jr. | 473/386 |
| 3,658,331 | A | * | 4/1972 | Driscoll | 473/386 |
| 3,671,036 | A | * | 6/1972 | Rubino | 473/386 |
| 4,360,199 | A | | 11/1982 | Jackson | |
| D279,208 | S | * | 6/1985 | Schuster | D21/793 |
| 4,896,883 | A | * | 1/1990 | Wagenknecht | 473/386 |
| 4,982,510 | A | * | 1/1991 | Musillo | 33/833 |
| 4,989,868 | A | * | 2/1991 | Manko | 473/386 |
| D321,544 | S | * | 11/1991 | Axne | D21/793 |
| 5,242,161 | A | * | 9/1993 | Wilkirson | 473/386 |
| 5,634,862 | A | * | 6/1997 | Gamache | 473/386 |
| 5,728,012 | A | * | 3/1998 | Boelling | 473/386 |
| 5,839,972 | A | | 11/1998 | Swanson | |
| 5,913,737 | A | * | 6/1999 | Park | 473/386 |
| 6,287,219 | B1 | | 9/2001 | Addington | |
| 6,428,429 | B1 | * | 8/2002 | Lee | 473/386 |
| 6,932,722 | B2 | * | 8/2005 | Wood | 473/386 |
| 7,850,550 | B2 | * | 12/2010 | Nania et al. | 473/408 |
| 2002/0103044 | A1 | * | 8/2002 | Smith et al. | 473/386 |
| 2002/0183138 | A1 | | 12/2002 | Malcolm | |
| 2007/0042839 | A1 | | 2/2007 | Smith et al. | |
| 2008/0135444 | A1 | | 6/2008 | Malcom | |
| 2009/0093322 | A1 | * | 4/2009 | Osterberg | 473/386 |
| 2009/0325734 | A1 | | 12/2009 | Nania et al. | |

* cited by examiner

*Primary Examiner* — Steven Wong
(74) *Attorney, Agent, or Firm* — Robert C. Montgomery; Montgomery Patent & Design

(57) ABSTRACT

A hand-held golf tee tool which ensures a consistent vertical placement of a golf tee comprises a "T"-shaped body. The body includes a recess which mimics the shape of a golf tee in order to retain the golf tee via friction fit for placement in a desired ground area. Height adjustment segments are removably attached to a lower surface of the body to increase the height of the golf tee.

10 Claims, 3 Drawing Sheets

GOLF TEE POSITIONING TOOL

RELATED APPLICATIONS

Not Applicable.

FIELD OF THE INVENTION

The present invention relates generally to golf training devices, and in particular, to a golf swing training aid which provides a visible target positioned in front of a golf ball to direct a follow-through of a swing path.

BACKGROUND OF THE INVENTION

The game of golf has become one (1) of the most technologically advanced sports in the world today. Experts in science and physics have combined state of the art materials with ergonomic and aerodynamic principles in order to produce golf clubs and golf balls that produce more accurate and consistently longer golf shots. Even with all of this technology however, people still have difficulty in mastering the basics of the game, such as the simple ability to place the golf ball on the tee properly. Many people inadvertently place the tee into the ground at an angle, while others place it in too far or not far enough. Such inconsistencies can account for a great swing on one (1) hole and a "so-so swing" on the next. Accordingly, there exists a need for a means by which golf tees can be properly and consistently inserted in an effort to improve one's golf swing in a consistent manner. The development of the golf tee placement and alignment tool fulfills this need.

There have been attempts in the past to provide a golfer with such a tool. U.S. Pat. App. Pub. Nos. 2002/0183138 and 2008/0135444 in the name of Malcolm disclose a combination golf tee setter, divot tool, and golf ball marker. Unfortunately, the Malcolm device does not provide for a means to provide an add-on height adjustment adapter as the present invention.

U.S. Pat. App. Pub. No. 2007/0042839 in the name of Smith et al. describes a golf tee height regulator and installation tool. The tool utilizes a golf tee securement foot and an extendable shaft maneuvering the head of the golf tee actuated by a set screw. The Smith et al. device does not fall under the scope of the present invention which comprises a single hand-held upper body with a recess to hold the golf tee in and removably attachable height adjustment portions.

U.S. Pat. No. 5,242,161 in the name of Wilkerson discloses a device to customize the height of a golf tee, providing detachable segments on the top portion of the stem of the device. The golf tee is placed through a center hole of the stem. The present invention comprises a main body having a recess matching the shape of the golf tee and is easier to remove once in place. Also, the height adjustment portions are on the bottom of the main body.

SUMMARY OF THE INVENTION

The inventor has recognized the aforementioned inherent problems and lack in the art and observed that there is a need for an apparatus by which golf tees can be positioned in the ground with a simple, easy-to-use tool with a single hand. The principles of the present invention provide for an apparatus for positioning a golf tee to address this identified need.

Accordingly, it is an object of the present embodiments of the invention to address this need by providing an tool comprising a main body and a plurality of height adjustment segments removably attached to the main body.

It is a further object of the present embodiments of the invention to provide such a main body comprising a "T"-shaped member having a recess along a face thereof shaped to generally correspond to that of a golf tee. The recess is centrally positioned along a central vertical axis of the "T"-shaped member. A golf tee is able to placed therein.

It is yet a further object of the present embodiments of the invention to provide such a plurality of height adjustment segments each comprising at least one (1) fastener located at an upper surface thereof for fastening to a corresponding fastener in the bottom of the main body. Each height adjustment segment further comprises a recess along a central vertical axis thereof to match the general shape of the shaft of a golf tee. When each height adjustment segment is attached to the main body or an adjacent height adjustment segment, the recesses align with the recesses of the main body and adjacent height adjustment segment to permit the placement of a golf tee therein.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

| DESCRIPTIVE KEY | |
|---|---|
| 10 | golf tee placement and alignment tool |
| 15 | upper body |
| 20 | main shaft |
| 25 | handle |
| 30 | add-on height adjustment segment |
| 35 | recess |
| 40 | golf tee |
| 45 | alignment nomenclature |
| 50 | cutout |
| 55 | lower portion |
| 60 | bottom surface |
| 65 | grade (earth) |
| 70 | height ("h") |
| 75 | mechanical fastener |
| 80 | male component |
| 85 | add-on female component |
| 87 | upper body female component |
| 90 | user's hand |
| 95 | index finger |
| 100 | travel direction path arrow |
| 105 | main shaft female component |

DETAILED DESCRIPTION OF THE PREFERRED EMBODIMENT

In accordance with the invention, the best mode is presented in terms of a preferred embodiment, herein depicted within FIGS. 1 through 4. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Figure 1:
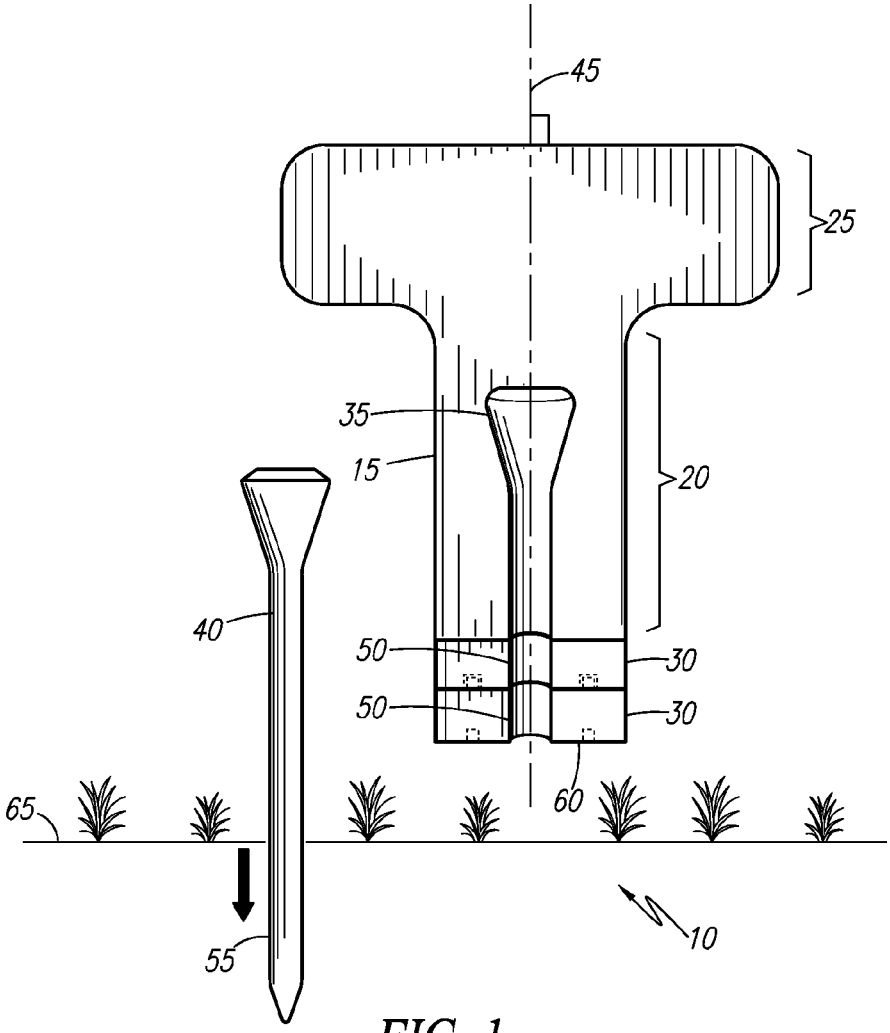
FIG. 1 is an elevational view of the golf tee placement and alignment tool 10, according to the preferred embodiment of the present invention.

Referring now to FIG. 1, an elevational view of the golf tee placement and alignment tool 10 (herein described as the "tool"), according to the preferred embodiment of the present invention, is disclosed. The tool 10 is comprised of an upper body 15 having a main shaft 20 and a "T"-shaped handle 25. In addition, the tool 10 comprises one (1) or more add-on height adjustment segments 30 which are attached at the lower or distal end of the main shaft 20. Further functionality and operational characteristics of the add-on height adjustment segments 30 will be provide herein below.

The main shaft 20 is provided with a golf tee-shaped recess 35 which accepts approximately half of the volume of a golf tee 40 arranged about its vertical symmetrical axis as shown. The vertical axis of the golf tee 40 is perpendicular to the handle 25 as depicted by alignment nomenclature 45. The recess 35 continues into the each of the adjustment segments 30 as shown as cylindrical-shaped cutouts 50. Thus, when a golf tee 40 is placed into the recess 35 and at least one (1) of the cutouts 50, a lower portion 55 remains exposed. Such lower portion 55 is consistent in overall length and results in a consistent insertion of the golf tee 40 when inserted into the ground using the tool 10.

As aforementioned described, the alignment of the recess 35 is perpendicular to bottom surface 60 of the main shaft 20 or each of the adjustment segments 30 as utilized. This results in a perpendicular insertion into grade (earth) 65 when the bottom surface 60 is placed flush and in full contact with the grade (earth) 65. It is envisioned that the tool 10 would be manufactured from plastic although other materials such as steel, aluminum or the like could be used with equal effectiveness and should not be considered as a limiting factor of the present invention.

Figure 2:
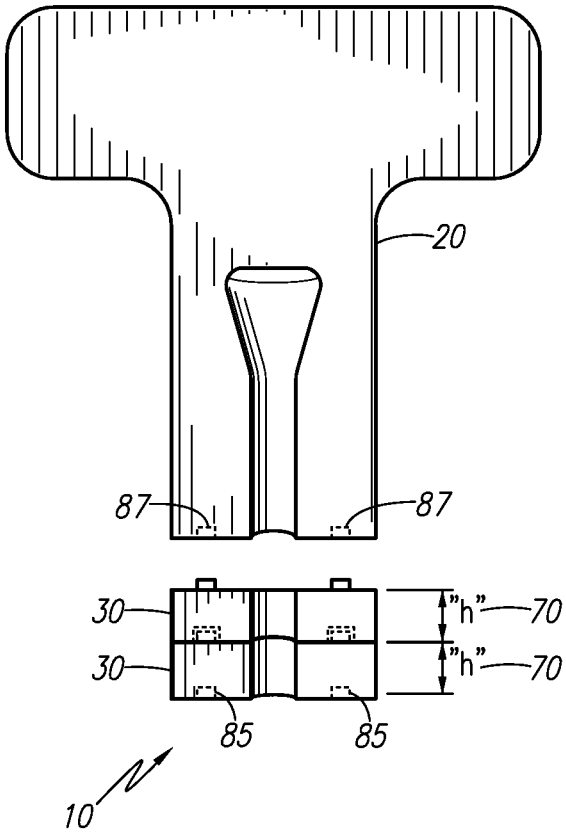
FIG. 2 is an exploded view of the golf tee placement and alignment tool 10 according to the preferred embodiment of the present invention.

Referring next to FIG. 2, an exploded elevational view of the tool 10 according to the preferred embodiment of the present invention is depicted. This figure clearly shows the "add-on" characteristics of each adjustment segment 30 in relation to the main shaft 20. It is envisioned that the overall height ("h") 70 of each add-on height adjustment segment 30 is approximately one-quarter inch (¼ in). Thus, should two (2) of the add-on height adjustment segment 30 be used as shown, this will result in an elevation delta of approximately one-half (½ in). This will effectively raise the golf tee 40 (as shown in FIG. 1) an additional approximate one-half (½ in) resulting in a lower portion 55 (as shown in FIG. 1) that is approximately one-half (½ in) less.

It is envisioned that once a golfer finds the satisfactory height ("h") 70, continuous and repeated insertions in accordance with that height ("h") 70 will result in better and more repeatable golf swings. Connection between the main shaft 20 and the add-on height adjustment segments 30 is made by a pair of mechanical fasteners 75. Each mechanical fastener 75 is envisioned to be mechanical in nature and would involve the use of magnets; snap friction fit couplings or the like. The use of a specific type of mechanical fastener 75 is not necessary and should not be interpreted as a limiting factor of the present invention. The pair of mechanical fasteners 75 would involve the use of a male component 80 on the upper side of each add-on height adjustment segment 30, and a female component 85 (not visible in this FIG. due to illustrative limitations) on the lower side of each add-on height adjustment segment 30 as well a female component 87 on the lower side of the main shaft 20. Such attachment and removal of various add-on height adjustment segments 30 can be made without the use of external tools.

Figure 3A:
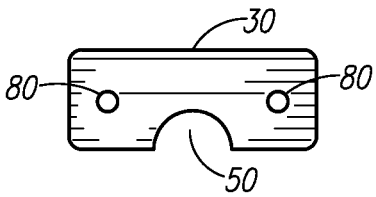
FIG. 3*a* is a top plan view of the golf tee placement and alignment tool 10 according to the preferred embodiment of the present invention.

Referring now to FIG. 3, a sectional view of the tool 10 according to the preferred embodiment of the present invention is shown. This figure clearly shows the male component 80 on the upper side of each add-on height adjustment segment 30. Such orientation results in a self-aligning configuration ensuring that the cutouts 50 of the height adjustment segment 30 aligns with other cutouts 50 of other height adjustment segment 30 as well as with the recess 35 (as shown in FIG. 1) of the main shaft 20 (as shown in FIG. 1).

Figure 3B:
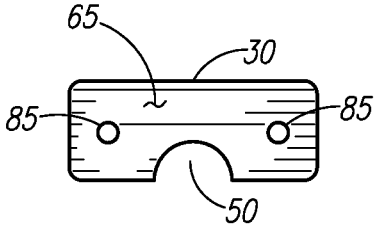
FIG. 3*b* is a bottom plan view of the golf tee placement and alignment tool 10 according to the preferred embodiment of the present invention; and, FIG. 4 is an elevational view of the golf tee placement and alignment tool 10 depicted in a utilization state according to the preferred embodiment of the present invention.

Referring next to FIG. 3*b*, a sectional view of the tool 10 according to the preferred embodiment of the present invention is disclosed. This figure clearly shows the female component 87 located on the lower side of the main shaft 20 which also functions as the bottom surface 60 should no additional add-on height adjustment segments 30 be utilized. A similar view would be provided on the lower side or under side of each respective add-on height adjustment segment 30 as well. Such orientation results in a self-aligning configuration ensuring that the cutouts 50 of the subject add-on height adjustment segments 30 aligns with other cutouts 50 of other add-on height adjustment segments 30 as well as with the recess 35 (as shown in FIG. 1) of the main shaft 20 (as shown in FIG. 1).

Figure 4:
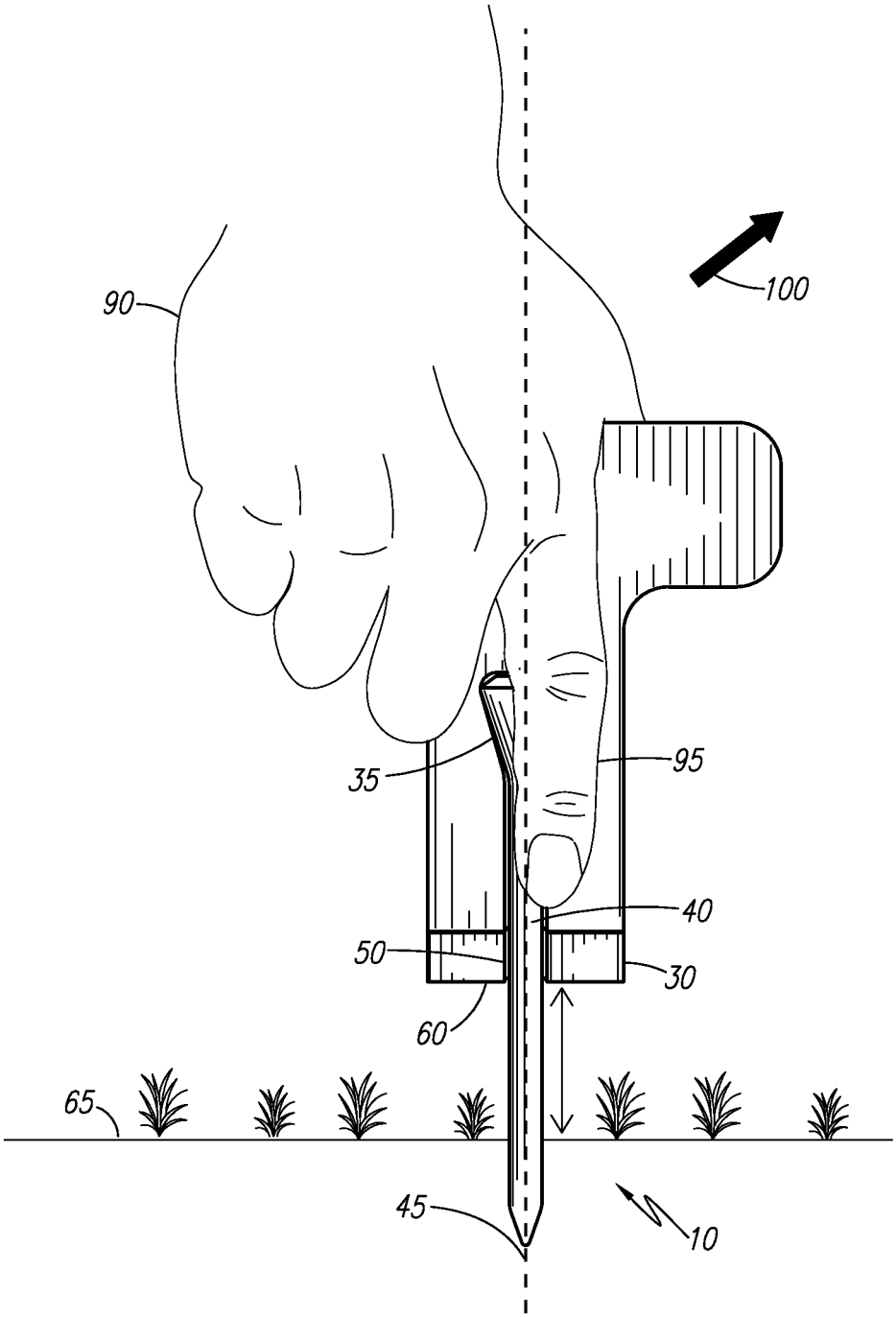

Referring finally to FIG. 4, an elevational view of the tool 10 depicted in a utilization state according to the preferred embodiment of the present invention is depicted. This figure depicts the golf tee 40 placed within the recess 35 of the main shaft 20 and the cutouts 50 of the add-on height adjustment segments 30. The tool 10 and the golf tee 40 are gripped by a user's hand 90 as shown with an index finger 95 used to hold the golf tee 40 within the confines of the tool 10 so that it does not inadvertently fall out during the insertion process. This hand grip position is held as the lower portion 55 of the golf tee 40 is inserted into grade (earth) 65 with the aid of the tool 10. As the golf tee 40 is driven in, a stop is provided by the bottom surface 60 as it contacts the grade (earth) 65. At such a point, the golf tee 40 is not only placed in a vertical manner that is perfectly perpendicular to the surface of the grade (earth) 65, but is also inserted to the same depth and placement as all other insertions before this point. After insertion, the user simply removes their index finger 95 from the golf tee 40 and slides the tool 10 backward along a travel direction path arrow 100 as shown. In such a manner, the golfer is provided with a golf tee 40 that is perfectly aligned and consistently placed from shot to shot thus removing one of the variables that are present in every golf swing.

In a non-limiting exemplary embodiment, the present disclosure provides a combined golf tee and golf tee placement and alignment tool. Such a combination includes a golf tee 40 and a golf tee placement and alignment tool 10. The golf tee placement and alignment tool includes an upper body 15 including a main shaft 20 including a centrally-registered vertical axis, and a recess 35 having a golf tee shape aligned with the vertical axis. Such a recess 35 accepts an upper portion of the golf tee 40 such that the golf tee 40 is aligned along the vertical axis of the main shaft 20. A "T"-shaped handle 25 is attached to the main shaft 20. Such a "T"-shaped handle 25 is disposed above the recess 35 and situated at a proximal end of the upper body 15. The main shaft 20 is rectilinear and monolithically formed with the "T"-shaped handle 25. The vertical axis passes through the golf tee 40 and is registered parallel to a longitudinal length thereof.

In a non-limiting exemplary embodiment of the aforementioned combination, at least one (1) height adjustment segment 30 is removably attached to a distal end of the main shaft 20 opposite to the "T"-shaped handle 25. Notably, the at least one (1) height adjustment segment 30 includes a cutout 50 capable of partially receiving a portion of the golf tee 40.

In a non-limiting exemplary embodiment of the aforementioned combination, the at least one (1) height adjustment segment includes an upper side and a male component 80 attached thereto, as well as a lower side and a female component 85 attached thereto. Advantageously, the male and female components 80, 85 are detachably mated and self-aligning in such a manner that the at least one (1) height adjustment segment 30 is vertically aligned with the main shaft 20. Notably, the recess 35 is vertically aligned and contiguously engaged directly with the cutout 50 when the at least one (1) height adjustment segment 30 is coupled to the female components 87 of the main shaft 20.

In a non-limiting exemplary embodiment of the aforementioned combination, a first one (1) of the at least one (1) height adjustment segment 30 has a first one (1) of the cutouts 50. Likewise, a second one (1) of the at least one (1) height adjustment segment 30 has a second one (1) of the cutouts 50. Advantageously, the first cutout 50 is vertically aligned and contiguously engaged with the second cutout 50 when the male component 80 of the at least one (1) height adjustment segment 30 is inserted directly into the female component 85 of the at least one (1) height adjustment segment 30.

In a non-limiting exemplary embodiment of the aforementioned combination, the main shaft 20 includes a female component 87 formed at the distal end thereof. As an example, the male component 80 of the at least one (1) height adjustment segment 30 is removably coupled to the female component 87 of the main shaft 20.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. It is envisioned that the tool 10 would be constructed in general accordance with FIG. 1 through FIG. 3*b*. Said construction would utilize plastic injection molding, casting, and/or machining depending on the material of construction. Said construction could follow many price set points from a novelty apparatus that is given away free as marketing and/or advertising incentive, to a high cost item using rare or valuable materials and coatings.

During initial use of the tool 10, the user would apply none, one (1), or more of the add-on height adjustment segments 30 to the bottom of the main shaft 20 as shown in FIG. 1. It is envisioned that the subsequent uses of the tool 10 would provide the user with the ideal insertion depth that would be used on a continual basis. Subsequent adjustments of the quantity of add-on height adjustment segments 30 added to the tool 10 would not be required. Such consistent insertion would then provide the golfer with a stable and consistent platform to hit the ball from resulting in continuous improvement over time as one's swing is refined and perfected without the variable of golf ball placement in regards to height above the grade (earth) 65 or displacement from a perpendicular position. Prior to insertion, the user would place a golf tee 40 within the confines of the recess 35 and the cutouts 50 and secure it in place on a temporary basis using the index finger 95 of the user's hand 90 holding the tool 10. At this point in time, the tool 10 is ready for use.

During the actual insertion process, the user inserts the lower portion 55 into the grade (earth) 65 at the desired location. By applying force to the handle 25, the golf tee 40 is easily inserted into even the hardest of grade (earth) 65. By continuous application of force, the bottom surface 60 will contact the grade (earth) 65 thus ensuring a consistent and perpendicular insertion. At this point in time, the tool 10 is removed from the golf tee 40 by removing one's index finger 95 and sliding the tool 10 backwards along the travel direction path arrow 100. This leaves the golf tee 40 behind and ready to accept a golf ball. Said process repeats on a continuous basis with the same or other golf tee 40 as required. It is envisioned that the tool 10 would be utilized during practice, actual games or competition or anytime an insertion of a golf tee 40 is required.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A golf tee placement and alignment tool comprising:

an upper body including:

a main shaft including:

an upper end, a lower end vertically opposed to said upper end, and a planar vertical surface extending from said upper end to said lower end;

a centrally-registered vertical axis; and, a height adjustment segment removably attached to said lower end of said main shaft, said height adjustment segment including:

an upper end, a lower end vertically opposed to said upper end, and a planar vertical surface extending from said upper end to said lower end;

a cutout disposed in said planar vertical surface, said cutout having a semi-circular shape extending from said lower end to said upper end and aligned with said vertical axis, wherein said cutout is capable of receiving a lower portion of a golf tee;

a recess disposed in said planar vertical surface, said recess having a golf tee shape extending from said lower end toward said upper end and aligned with said vertical axis, wherein said recess is capable of accepting an upper portion of said golf tee such that said golf tee is aligned along said vertical axis of said main shaft; and, a "T"-shaped handle attached to said upper end of said main shaft, said "T"-shaped handle being disposed above and spaced apart from said recess.

2. The golf tee placement and alignment tool of claim 1, wherein:

said height adjustment segment comprises a male component disposed on said upper end of said height adjustment segment, and, said main shaft includes a female component disposed on said lower end of said main shaft; and said male component and said female component are detachably mated and self-aligning in such a manner that said vertical surface of said height adjustment segment is coplanar with said vertical surface of said main shaft and said cutout is vertically aligned and contiguously engaged with said recess.

3. The golf tee placement and alignment tool of claim 1, further comprising a plurality of height adjustment segments, wherein:

a first height adjustment segment of said plurality of said height adjustment segments is removably attachable to said lower end of said main shaft;

said first height adjustment segment comprises:

a first upper end, a first lower end vertically opposed to said first upper end, and a first planar vertical surface extending from said first upper end to said first lower end; and a first cutout disposed in said first planar vertical surface, said first cutout having a semi-circular shape extending from said first lower end to said first upper end and aligned with said vertical axis;

said first cutout is capable of receiving a lower portion of said golf tee;

a second height adjustment segment of said plurality of height adjustment segments comprises:

a second upper end, a second lower end vertically opposed to said second upper end, and a second planar vertical surface extending from said second upper end to said second lower end; and a second cutout disposed in said second planar vertical surface, said second cutout having a semi-circular shape extending from said second lower end to said second upper end and aligned with said vertical axis; and said second upper end is removably attached to said first lower end.

4. The golf tee placement and alignment tool of, claim 1 further comprising one or more additional height adjustment segments, wherein:

each additional height adjustment segment comprises:

an upper end, a lower end vertically opposed to said upper end, and a planar vertical surface extending from said upper end to said lower end;

a cutout disposed in said planar vertical surface, said cutout having a semi-circular shape extending from said lower end to said upper end and aligned with said vertical axis, wherein said cutout is capable of receiving a lower portion of said golf tee;

a male component disposed on said upper end of said additional height adjustment segment; and a female component disposed on said lower end of said additional height adjustment segment; and said male component of said additional height adjustment segment and said female component of said height adjustment segment are detachably mated and self-aligning in such a manner that said vertical surface of said height adjustment segment and said vertical surface of said additional height adjustment segment are coplanar with said vertical surface of said main shaft and said cutout of said height adjustment segment and said cutout of said additional height adjustment segment are vertically aligned and contiguously engaged with said recess.

5. The golf tee placement and alignment tool of claim 1, wherein alignment of said recess is perpendicular to said lower end of said height adjustment segment.

6. The golf tee placement and alignment tool of claim 1, wherein alignment of said recess is perpendicular to said upper end of said main shaft.

7. The golf tee placement and alignment tool of claim 1, wherein:

said main shaft is rectilinear;

said main shaft and said "T"-shaped handle are monolithically formed; and, said vertical axis passes through said golf tee and is registered parallel to a longitudinal length thereof.

8. The golf tee placement and alignment tool of claim 4, wherein alignment of said recess is perpendicular to said lower end of a lower most height adjustment segment of said additional height adjustment segments.

9. The golf tee placement and alignment tool of claim 3, wherein:

said first height adjustment segment comprises:

a first male component disposed on said first upper end; and a first female component disposed on said first lower end;

said second height adjustment segment comprises:

a second male component disposed on said second upper end; and a second female component disposed on said second lower end;

said main shaft includes a female component disposed on said lower end of said main shaft;

said first male component and said female component of said main shaft are detachably mated and self-aligning such that said first vertical surface and said vertical surface of said main shaft are coplanar and said first cutout and is vertically aligned and contiguously engaged with said recess; and said second male component and said first component are detachably mated and self-aligning such that said first vertical surface and said second vertical surface are coplanar and said first cutout is vertically aligned and contiguously engaged with said second cutout.

10. The golf tee placement and alignment tool of claim 9, wherein alignment of said recess is perpendicular to said second lower end of said second height adjustment segment.

* * * * *